US005247143A

United States Patent [19]

Suwa

[11] Patent Number: 5,247,143

[45] Date of Patent: Sep. 21, 1993

[54] KEY SWITCH

[75] Inventor: Kaname Suwa, Yokohama, Japan

[73] Assignee: Canon Kabushiki Kaisha, Tokyo, Japan

[21] Appl. No.: 830,336

[22] Filed: Jan. 31, 1992

Related U.S. Application Data

[62] Division of Ser. No. 663,430, Mar. 1, 1991, Pat. No. 5,144,103.

[30] Foreign Application Priority Data

Mar. 9, 1990 [JP] Japan ..... 2-056506
Mar. 12, 1990 [JP] Japan ..... 2-057973

[51] Int. Cl.[5] ..... H01H 1/10

[52] U.S. Cl. ..... 200/517; 200/513; 200/515; 200/344

[58] Field of Search ..... 200/517, 516, 513, 345, 200/514, 515, 344, 393, 342, 520, 521, 556, 288, 511, 523, 341, 518, 335

[56] References Cited

U.S. PATENT DOCUMENTS

| | | | |
|---|---|---|---|
| 3,292,761 | 12/1966 | Erpel | 200/344 |
| 4,384,796 | 5/1983 | Denley | 200/344 |
| 4,441,000 | 4/1984 | Suwa | 200/291 |
| 4,493,959 | 1/1985 | Viebrantz | 200/340 |
| 4,532,575 | 7/1985 | Suwa | 361/413 |
| 4,580,022 | 4/1986 | Oelsch et al. | 200/344 |
| 4,590,342 | 5/1986 | Schlegel | 200/341 |
| 4,611,261 | 9/1986 | Suwa | 361/399 |
| 4,638,151 | 1/1987 | Suwa | 235/145 R |
| 4,641,004 | 2/1987 | Keprda | 200/341 |
| 4,675,787 | 6/1987 | Suwa | 361/401 |
| 4,681,987 | 7/1987 | Suwa | 200/5 A |
| 4,814,561 | 3/1989 | Kawasaki | 200/513 |
| 4,902,862 | 2/1990 | Oelsch et al. | 200/344 |
| 5,003,140 | 3/1991 | Abell, Jr. et al. | 200/344 |
| 5,117,076 | 5/1992 | Damitio | 200/344 |

FOREIGN PATENT DOCUMENTS

| | | | |
|---|---|---|---|
| 271124 | 5/1986 | France | 200/344 |

*Primary Examiner*—Henry J. Recla
*Assistant Examiner*—David J. Walczak
*Attorney, Agent, or Firm*—Fitzpatrick, Cella, Harper & Scinto

[57] ABSTRACT

A push button switch includes an elastic sheet member serving as a stopper of an operation member and an elastic projection. When the operation member abuts with the projection, it is elastically deformed to absorb abutment impact to thereby cost effectively reduce noise when the push button switch is operated. A key switch includes a torsion bar, a key top and, an elastic sheet member having a projection. The play of a torsion bar at a bearing portion and at a coupling portion of the torsion bar with the key top is eliminated through a pushing force by the elastic sheet member having a projection, to thereby reduce noise and prevent trapping of a key stem by another component, when the key switch is operated.

5 Claims, 5 Drawing Sheets

KEY SWITCH

This application is a division of application Ser. No. 07/663,430 filed Mar. 1, 1991, now U.S. Pat. No. 5,144,103.

BACKGROUND OF THE INVENTION

1. Field of the Invention

The present invention relates to a push button switch and a key switch. More particularly, the present invention relates to a push button switch of the type that an operation member for displacing a movable contact is provided movable in a depression direction and in a recovery direction opposite to the depression direction respectively of the key top, within a predetermined stroke defined by abutment of the operation member with a stopper, and the operation member is biased in the recovery direction by an elastic sheet member. Furthermore, the present invention relates to a key switch of the type that a key top is elastically biased by an elastic sheet member in a recovery direction opposite to a depression direction of the key top, and a torsion bar is provided to prevent trapping of the key switch by another component.

2. Related Background Art

There is shown in FIG. 1 the structure of a first example of a conventional push button switch of this type used, for example, as a key switch of a keyboard of an electronic desk-top calculator.

This switch uses a key sheet 1 made of a high elasticity material such as silicon rubber and having a hollow dome portion 1*a*. A movable contact 1*d* is provided at the top inner surface of the dome portion 1*a*. As an operator depresses the key top 5 with a finger, a key stem 2 movably supported up and down by a frame 4 lowers to push down the dome portion 1*a*. The dome portion 1*a* is then elastically deformed so that the movable contact 1*d* lowers and contacts fixed contacts 3*a* and 3*b* on a printed circuit board 3 to short-circuit them, thereby entering a key input.

Thereafter, the key stem 2 reaches the bottom dead point of the vertical motion stroke, and abuts a base portion 1*e* of the key sheet 1 serving as a stopper at the bottom dead point. Impact at this abutment is absorbed by elastic deformation of the base portion 1*e*.

When the operator detaches the finger from the key top 5, the key stem 2 moves upward from the bottom dead point by elastic deformation energy stored in the dome portion 1*a*. If the flange 2*a* of the key stem 2 abuts directly with a top dead point stopper portion 4*c* of the frame 4, an impact sound of discordant noises is generated.

In view of this, as shown in FIG. 1, an elastic absorber such as an O-ring 6 is interposed between the flange 2*a* of the key stem 2 and the stopper portion 4*c* of the frame 4, to thereby cushion the impact of the returning key stem 2 and absorb the impact sound.

With the above structure, however, an absorber such as an O-ring 6 is required to be mounted for each key switch. In addition, the number of absorbers must be the same as the number of key switches of a keyboard. Thus, there arises the problem that the number of components and the number of assembly steps increase, resulting in high cost.

For an electronic apparatus having a keyboard, such as an electronic calculator, typewriter, and personal computer, a key switch frequently used has been configured as having a narrow and long key top, to improve the operability of the device. In such a case there has been adopted a structure in which a torsion bar is provided to prevent a key switch having an elongated key top from being inclined and trapped by another component when it is depressed at one end portion.

The structure widely used heretofore for a key switch of a keyboard of a compact electronic apparatus such as an electronic calculator has an arrangement that an elastic sheet member called a key sheet mounted with a movable contact is used to elastically bias the key top in the recovery direction opposite to the depression direction.

The structure of a second example of a conventional key switch having a torsion bar and a key sheet will be described with reference to FIGS. 2 and 3.

First, the basic structure of the key switch excepting the torsion bar mechanism will be described. Referring to FIG. 2 reference numeral 11 represents a key top which is formed in a narrow and long shape in the right and left direction as viewed in FIG. 2. A key stem 12 is fixedly connected to the lower middle surface of the key top 11.

The key stem 12 is fitted in a tubular guide portion 13*c* to be able to slide therein, the tubular guide portion being formed in a frame 13 of an electronic apparatus on which the key switch is assembled. The key stem 12 along with the key top 11 is able to slide in the up and down, directions as viewed in FIG. 2 (in the recovery direction and the depression direction of the key top).

A key sheet 14 is provided below the key stem 12. The key sheet 14 is made of an elastic material such as silicon rubber and has a hollow dome (projected portion) 14*b* projected from a flat base portion 14*a* of the key sheet 14. A movable contact 14*c* made of conductive rubber is attached to the inner top surface of the dome portion 14*b*. At the top of the dome portion 14*b*, there is formed a ring portion 14*d* which abuts with the lower surface of the key stem 12 so that the dome portion 14*b* pushes the key stem 12 upward.

The key sheet 14 is tightly attached to a printed circuit board 15 at its base portion 14*a*. On the printed circuit board 15, there are formed fixed contacts 15*a* and 15*a* constituting an input circuit of the key switch. The key sheet 14 is positioned such that the fixed contacts 15*a* and 15*a* face the movable contact 14*c*.

With the structure described above, when an operator depresses the key top 11 with a finger, the key top 11 along with the key stem 12 lowers to elastically deform the dome portion 14*b*, so that the movable contact 14*c* lowers to contact the fixed contacts 15*a* and 15*a* to short circuit them and enter a key input. In this state, when the operator detaches the finger from the key top 11, the dome portion 14*b* takes the original shape to push up the key stem 12 which along with the key top 11 returns to the initial position before the key operation.

Next, the mechanism of the torsion bar will be described.

As shown in FIG. 2, a pair of torsion bar holders (hereinafter abbreviated as bar holders) 16 and 16 is mounted on the lower surface of the key top 11 at opposite end portions in the lateral direction, by press-fitting or adhering the upper ends thereof in or to the key top 11. Each bar holder 16 is inserted into a hole 13*d* of the frame 13. As shown in FIG. 3, a U-character shaped groove 16*b* is formed in the lower end portion of the bar holder 16 facing the base portion 14*a* of the key sheet 14. A torsion bar 17 is coupled movable to the key top 11 via the bar holders 16 and 16.

The torsion bar 17 is made of a metal rod and formed in generally a U-character shape. Opposite end portions 17c of the torsion bar 17 are bent perpendicular to an intermediate portion 17b both in the same direction. The tips of the opposite end portions 17c are bent perpendicular to the opposite end portions 17c and face each other, the bent portions of the tips serving as operation ends 17a. The intermediate portion of the torsion bar 17 is parallel to the lateral direction of the key top 11. As shown in FIG. 11, the intermediate portion 17b is fitted in an inverted U-character shaped groove 13b formed at the lower end portion of a rib 13a extending downward from the frame 13. The torsion bar 17 is rotatably squeezed and borne by means of the rib 13a and a holding member 18 provided on the base portion 14a of the key sheet 14. Namely, the torsion bar 17 is rotatably borne using as a fulcrum the intermediate portion 17b. The operation ends 17a of the torsion bar 17 are fitted in the grooves 17a of the holders 16 rotatable and movable in the lateral direction.

Next, the operation of the torsion bar mechanism will be described.

As an operator depresses the key top 11 at the left end portion thereof as viewed in FIG. 2 in the direction indicated by an arrow B, an angular moment is applied to the key stem 12 in the counter-clockwise direction as viewed in FIG. 2. Thus, the key top 11 along with the key stem 12 tends to incline within the angle range defined by the clearance between the key stem 12 and a guide portion 13c of the frame 13.

In this case, the bar holder 16 at the left end along with the key top 11 lowers to push down the left operation end 17a. As a result, the left end portion 17c rotates in the counter-clockwise direction as viewed in FIG. 3 using as a fulcrum the intermediate portion 17b.

Since the torsion bar 17 is made of a metal rod having a high rigidity, the right end portion 17c also rotates similar to the left although the torsion bar is subjected to torsional deformation more or less. Therefore, the right operation end 17a pushes down the right bar holder 16 so that the right end portion of the key top 11 which is not depressed by the operator is also lowered. In this manner, the key top 11 is smoothly lowered while being inclined by a small amount.

According to the second example of a conventional key switch, in order to allow the operation ends 17a of the torsion bar 17 to smoothly move within the grooves 16b of the bar holders 16, the width of each groove 16b is set to have a suitable play (margin) while considering the dispersions and work tolerances of the diameter of the torsion bar 17. Similarly, the dimensions of the groove 13b of the rib 13a and the holding member 18 for bearing the intermediate portion 17b of the torsion bar 17 are also set to have a suitable play (margin).

However, with such a play, discordant click sounds will be generated when the key top 11 is depressed because the operation ends 17a and intermediate portion 17b of the torsion bar 17 abut with the inner surfaces of the grooves 16b and 13b.

Furthermore, the operation of the torsion bar mechanism delays the operation of the key top 11 due to the presence of the play. If there is a large play, the inclined angle of the key top 11, when it is depressed at one end portion, will become so large that the key stem 12 is trapped by the guide portion 13c of the frame 13, before the operation of the torsion bar mechanism becomes effective.

SUMMARY OF THE INVENTION

It is a first object of the present invention to provide a push button switch of the type described as the first example, capable of making noises small and cost effective.

It is another object of the present invention to provide a key switch of the type described as the second example, capable of making noises small and preventing the key stem from being trapped by another component.

DETAILED DESCRIPTION OF PREFERRED EMBODIMENTS

The first embodiment of an improved first example of a conventional switch according to the first type of a switch of this invention will be detailed first.

First embodiment

Figure 4:
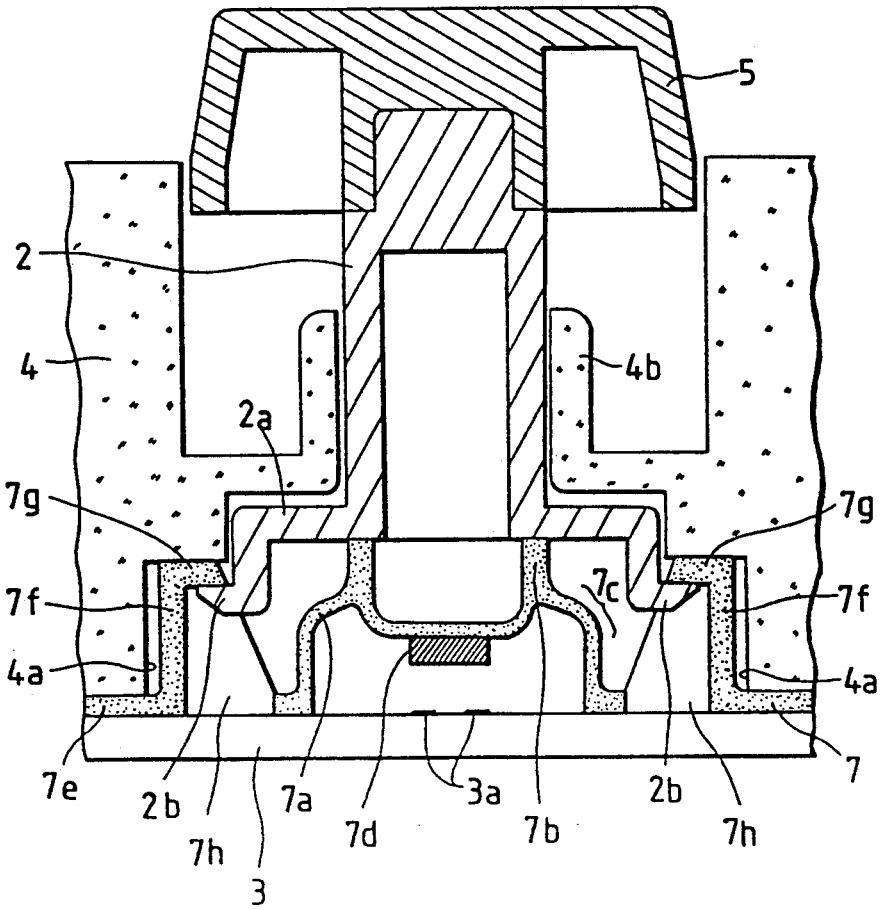
FIG. 4 is a cross sectional view showing a push button switch according to a first embodiment of this invention, which switch is of a first type of this invention and is an improved version of the first example of a conventional switch.
Figure 5:
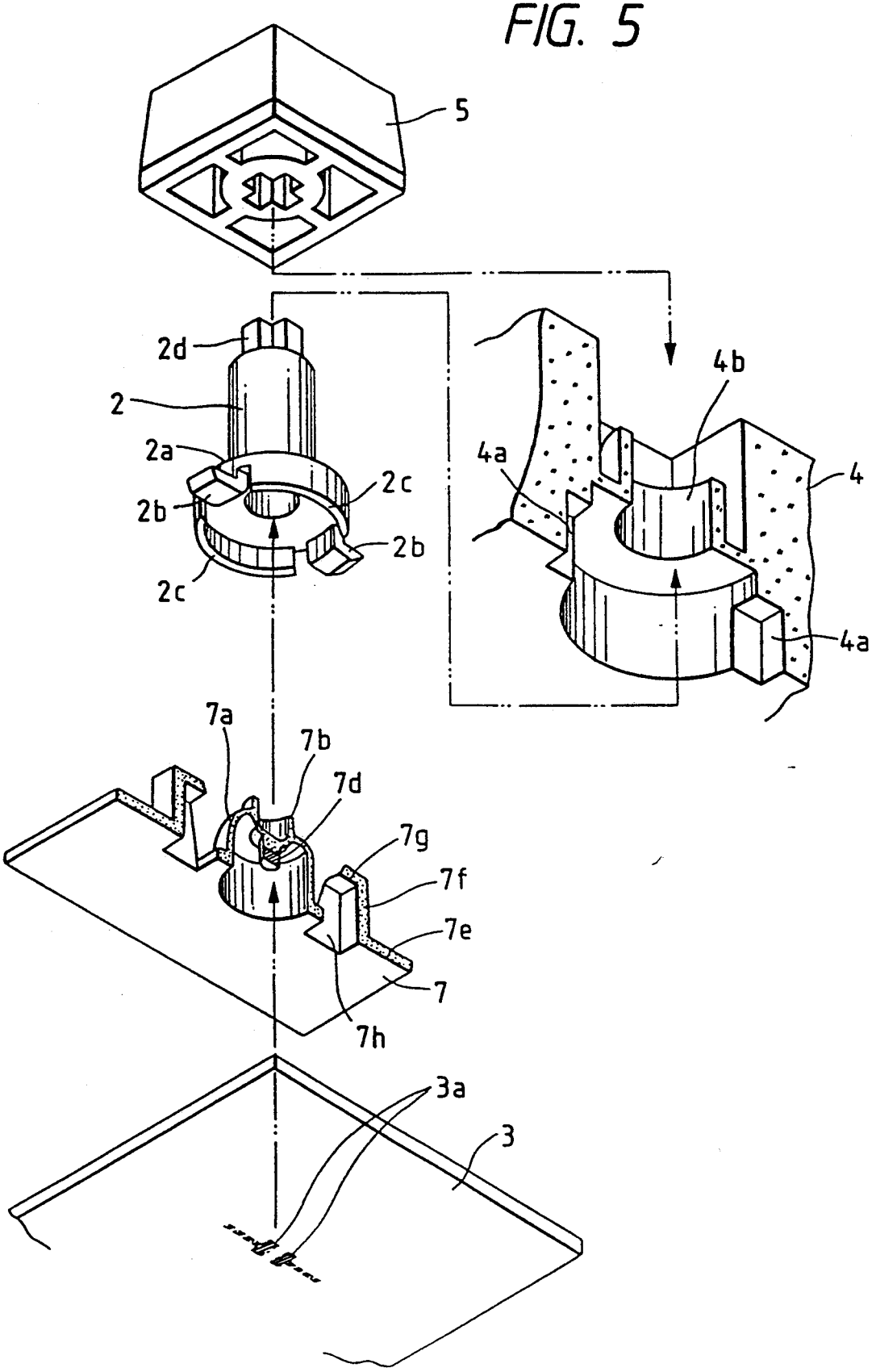
FIG. 5 is a broken perspective view of the switch shown in FIG. 4.

FIGS. 4 and 5 illustrate the structure of a push button switch according to a first embodiment of this invention. This push button switch is used for example as a key switch of an electronic calculator keyboard.

In FIGS. 4 and 5, reference numeral 2 represents a key stem which is an operation member for displacing a movable contact of a switch. This key stem 2 is fitted in a tubular guide 4b so as to be able to slide in the depression direction (downward direction in FIG. 4) and in the recovery direction (upward direction in FIG. 4) opposite to the depression direction. The tubular guide 4b is formed in a frame 4 of an electronic calculator on which the push button switch is mounted. A key top 5 is press-fitted in or adhered to the upper portion of the key stem 2. A disk type flange 2a is formed at the lower portion of the key stem 2. At the lower periphery of the flange 2a, there are provided a pair of L-character shaped claws 2b and a pair of arcuate ribs 2c, respectively positioned symmetrical to the central axis of the key stem 2. The claws 2b extend outside of the key stem 2 generally in the horizontal direction. The upper surface of each claw 2*b* is flat and the tip portion thereof is inclined for the purpose of facilitating assembly of the push button switch as will be described later.

There is provided a printed circuit board 3 under the frame 4. A wiring pattern (not shown) of an input circuit of the push button switch is formed on the upper surface of the printed circuit board 3. A pattern of a pair of fixed contacts 3*a* and 3*a* are formed facing the shaft of the key stem 2.

A key sheet 7 made of a high elasticity material such as silicon rubber is provided on the printed circuit board 3. The key sheet 7 is constituted by a flat base portion 7*c* and a hollow dome portion 7*a* projecting upward. On the ceiling of the hollow dome portion 7*a*, a movable contact 7*d* made of conductive rubber is formed. The key sheet 7 is disposed such that the movable contact 7*d* faces the fixed contacts 3*a* and 3*a*. The key stem 2 is supported by a top portion 7*b* of the dome portion 7*a* and biased upward by the elastic force of the dome portion 7*a*.

A pair of elastic projections 7*f* and 7*f* are formed near at and symmetrical to the dome portion 7*a* of the key sheet 7. Each elastic projection 7*f* has a cross section of an inverted L-character shape and is housed within a recess 4*a* formed under the frame 4. The claw 2*b* of the key stem 2 is positioned under the elastic projection 7*f* and comes into engagement therewith. As shown in FIG. 4, at the initial stage when the push button switch is not still depressed, the claw 2*b* of the key stem 2 biased upward by the dome portion 7*a* abuts with the lower surface of the horizontal upper end portion 7*g* of the elastic projection 7*f*. With this abutment, upward movement of the key stem 2 is prohibited. Namely, the upper end portion 7*g* of the elastic projection 7*f* serves as a stopper for the upward movement of the key stem 2.

The tip surface of the upper end portion 7*g* of the elastic projection 7*f* is inclined in the same direction as that of the tip surface of the claw 2*b* of the key stem 2. The upper portion 7*g* is in contact with the ceiling of the recess 4*a* of the frame 4.

In order to mold the elastic projection 7*f* integrally with the key sheet 7 through vulcanization of rubber material using a metal mold, a hole 7*h* is formed in the base portion 7*e* at the position where the elastic projection 7*f* is formed. With such an arrangement, the key sheet 7 having the integral elastic projection 7*f* can be molded using a simplest two-division mold type with upper and lower molds.

Next, an assembly method for a push button switch of this embodiment will be described.

The push button switch of this embodiment is assembled as illustrated by arrows in FIG. 5. First, the key stem 2 is inserted into the guide 4*b* from the lower side of the frame 4, with the claws 2*b* being aligned with the recesses 4*a* of the frame 4.

Next, the elastic projections 7*f* of the key sheet 7 are fitted in the recesses 4*a* of the frame 4 to mount the key sheet 7 under the frame 4. In this case, it is necessary to set the key sheet 7 at a predetermined position of the frame 4. This positioning can be precisely performed, for example, by providing a pair of bosses on the frame 4 and forming a corresponding pair of holes in the base portion 7*e* of the key sheet 7 to insert the bosses into the holes.

Then, the printed circuit board 3 is fixedly mounted to the lower surface of the key sheet 7 by means of screws or the like. In this condition, the key stem 2 is pushed upward by the top portion 7*b* of the dome portion 7*a* so that the claws 2*b* abut with the ceiling of the recesses 4*a*, and the upper portions 7*g* of the elastic projections 7*f* are elastically deformed to abut with the lower surfaces of the claws 2*b*. The positional relation as shown in FIG. 4 is not still completed in this condition.

Next, the key top 5 is press-fitted in a key top fitting portion 2*d* formed at the top end of the key stem. In this case, the key stem 2 is lowered and the ribs 2*c* are lowered to the bottom dead point position where they abut the base portion 7*e* of the key sheet 7 and stop at this position. During this operation, the claws 2*b* of the key stem 2 push down and get over the upper end portions 7*g* of the elastic projections 7*f* and enter into the inside of the elastic projections 7*f*. Then, the elastic projections 7*f* restore the original shape as shown by the positional relation of FIG. 4. Since the tip surfaces of the upper end portions 7*g* and the claws 2*b* are inclined in the same direction, the claws 2*b* easily enter into the elastic projections 7*f*.

In the above manner, assembly is completed to obtain a finished push button switch. The key stem 2 of the finished push button switch can move in the up and down directions as viewed in FIG. 4 within a predetermined stroke defined by an abutment of the claws 2*b* with the upper end portions 7*g* of the elastic projections 7*f* of the key sheet 7 and an abutment of the ribs 2*c* with the base portion 7*e*. Furthermore, the key stem 2 is elastically biased upward by the dome portion 7*a* of the key sheet 7.

Next, the operation of the push button switch of this embodiment will be described.

Referring to FIG. 4 showing the initial condition prior to the operation, as an operator depresses the key top 5 with a finger, the key stem 2 is lowered to push down and deform the dome portion 7*a*. Thus, the movable contact 7*d* is lowered to contact the fixed contacts 3*a* and 3*a* on the printed circuit board 3 so that they are short-circuited to enter a key input.

Thereafter, the ribs 2*c* of the key stem 2 reach the bottom dead point where they abut with the base portion 7*e* of the key sheet 7 serving as the bottom dead point stopper. At this abutment, the base portion 7*e* elastically deforms to absorb abutment impact.

Next, as the operator detaches his finger from the key top 5, elastic deformation energy stored in the side wall 7*c* of the dome portion 7*a* causes the key stem 2 to push up, so that the claws 2*b* restore the initial position prior to the operation, i.e., the top dead position shown in FIG. 4 where the claws 2*b* abut with the upper end portions 7*g* of the elastic projections 4*f*. When the claws 2*b* abut with the upper end portions 7*g*, the upper end portions 7*g* are elastically deformed to thereby absorb impact sounds caused by the abutment.

Figure 1:
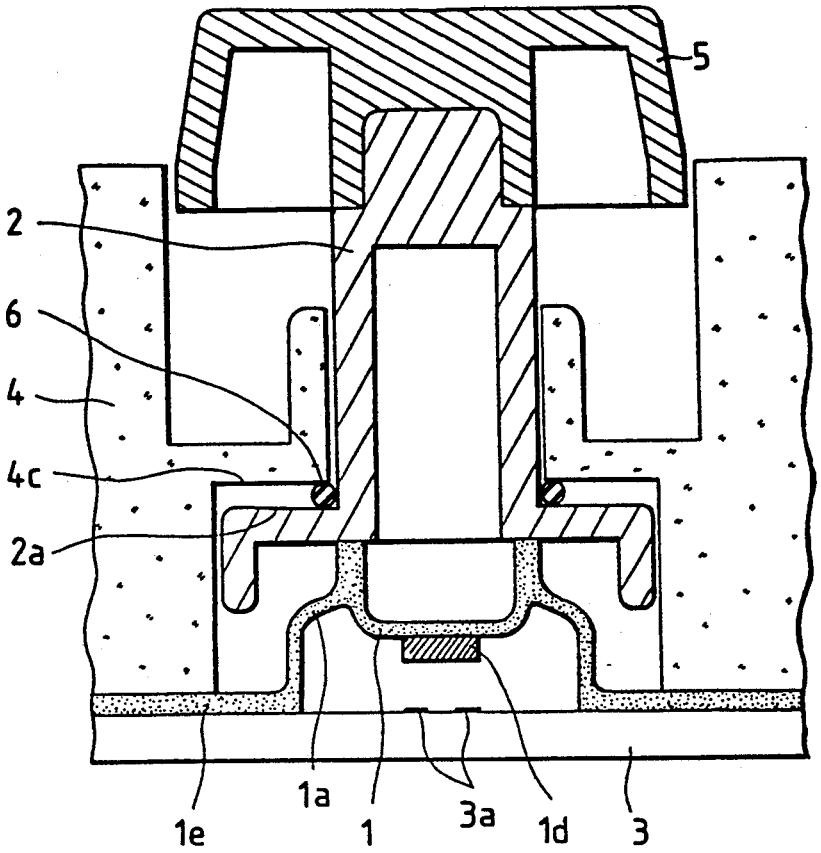
FIG. 1 PRIOR ART
FIG. 1 is a cross sectional view showing the structure of a push button switch according to a first example of a conventional switch.

As described above, according to the push button switch of this embodiment, impact generated when the key stem 2 recovers the initial position can be absorbed by the elastic projections 7*f* of the key sheet 7 serving as the stopper, to make impact sounds small. Furthermore, since the elastic projections 7*f* are integrally formed with the key sheet 7, the number of components can be reduced as compared with a conventional switch which uses an additional O-ring as shown in FIG. 1. Still further, assembling the switch of this embodiment requires no special work, and the assembly processes can be simplified because of the absence of a process of assembling a conventional dedicated absorber, thereby reducing the manufacturing cost of the device.

Second Embodiment

Figure 6:
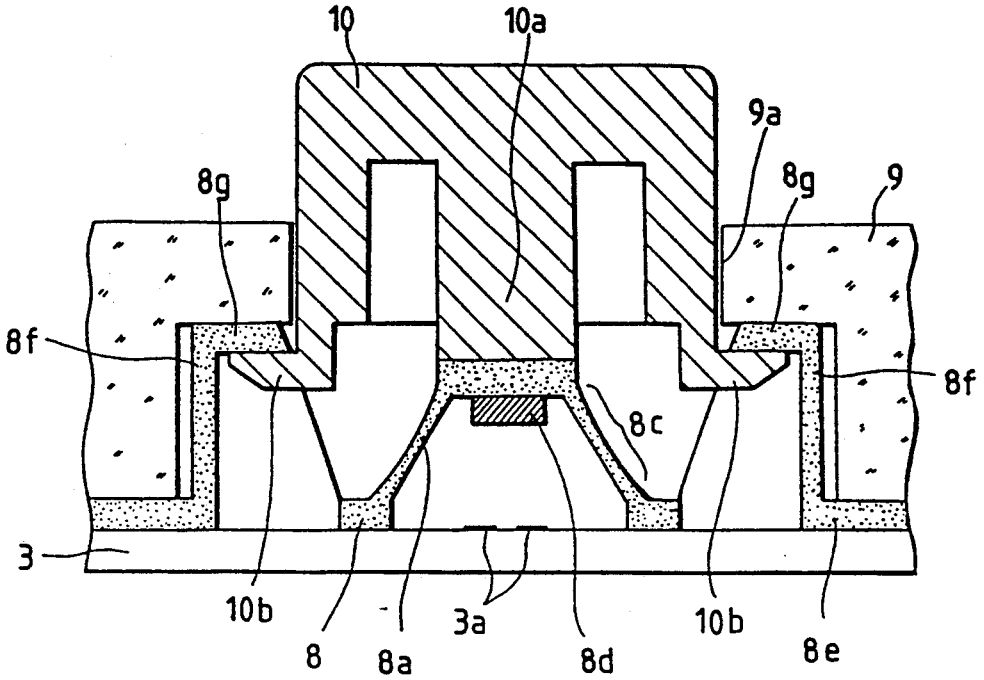
FIG. 6 is a cross sectional view showing the structure of a push button switch according to a second embodiment of this invention.

FIG. 6 shows the structure of a push button switch according to a second embodiment of this invention. In FIG. 6, elements common or corresponding to those shown in FIGS. 4 and 5 of the first embodiment are represented by using identical numerals, and the description of the common elements is omitted.

The structure of the push button switch of this embodiment is simpler than that of the first embodiment. A key top 10 is formed integrally with a key stem, and the cross section of the overall structure is generally of a hat (with a brim) shape. The key top 10 is fitted in a guide hole 9*a* formed in a frame 9 so as to be able to slide therein in the up and down directions. A projection 10*a* formed on the key top 10 is supported by a dome portion 8*a* of a key sheet 8 in contact relation therebetween. Claws 10*b* like 10 those of the first embodiment are formed at the lower end of the key top 10.

The claws 10*b* enter into the elastic projections 8*f* integrally formed with the key sheet 8 similar to the first embodiment. At the initial state prior to the operation as shown in FIG. 6, the projection 10*a* of the key top 10 is pushed up by the dome portion 8*a*, so that the claws 10*b* abut with the upper end portions 8*g* of the elastic projections 8*f* serving as a stopper of the key top 10 in the up direction.

With the structure described above, the operation of this embodiment is similar to the first embodiment. When the key top 10 integral with the key stem recovers the initial position, impact at this recovery can be absorbed by the upper end portions 8*f* of the key sheet 8 similar to the first embodiment, with the same advantageous effects as the first embodiment.

In this embodiment, the dome portion 8*a* of the key sheet 8 is generally of a truncated cone shape. The side wall 8*c* of the dome portion 8*a* is thick at the top portion and a base portion 8*e* and gradually becomes thin toward the central area. With this structure, when the dome portion 8*a* is pushed down and deformed by the key top 10, the thin portion of the side wall 8*c* buckles during the depression stroke, thereby abruptly reducing the repulsion force and providing a so-called click touch and good operability. Furthermore, in this embodiment, there is no over-stroke because the stroke position where a key input is entered is the bottom dead point.

The above absorber mechanism can also be applied to other types of push button switches. For example, instead of providing the movable contact 8*d* of the key sheet 8, a flexible film (not shown) formed with a movable contact may be disposed on the printed circuit board 3 with a spacer being interposed therebetween, and the film is pushed down by the dome portion 8*a* elastically deformed upon operation of the key top 10 to thereby enter a key input.

As is apparent from the foregoing description of the push button switch of the first type of this invention, there is provided an operation member for displacing a movable contact, the operation member being able to move in the depression direction and the recovery direction within a predetermined stroke restricted by abutment of the operation member with stoppers and being biased in the recovery direction by an elastic sheet member. In this push button switch, projections are formed integrally with the elastic sheet member, and the projections are used as the stopper of the operation member in the recovery direction. Accordingly, impact when the operation member recovers the initial position after the operation thereof can be cushioned to thus absorb impact sounds and make them small. Furthermore, the number of components and assembly steps can be reduced to made the device cost effective.

Next, a third embodiment of this invention which is of the second type of this invention and is an improved version of the second example of a conventional switch will be described.

Figure 2:
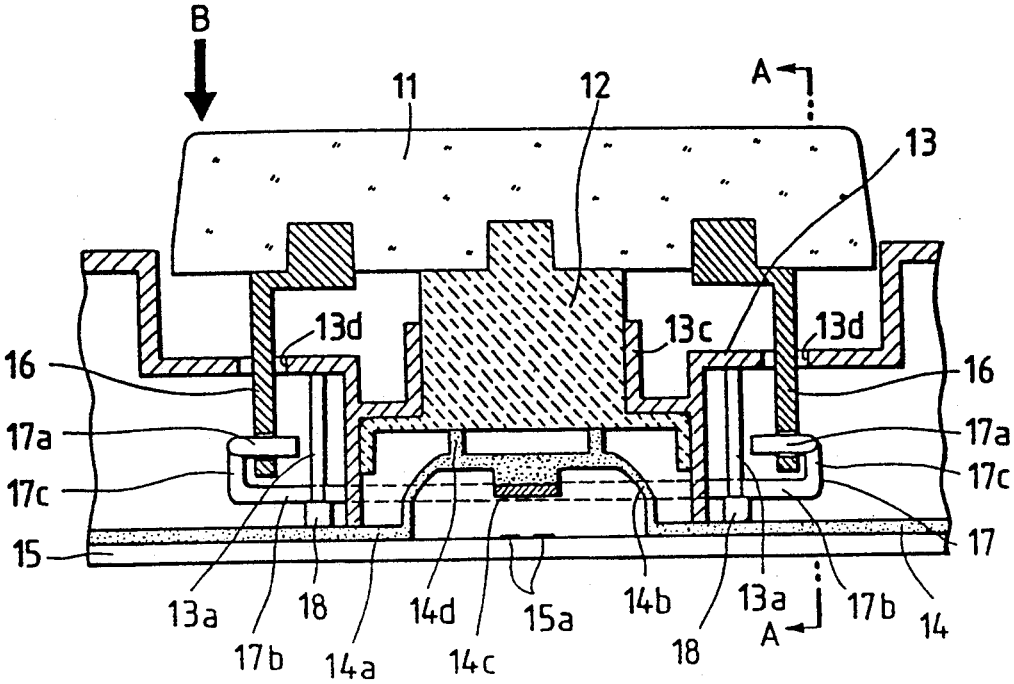
FIG. 2 PRIOR ART
FIG. 2 is a vertical and front cross sectional view showing the structure of a key switch according to a second example of a conventional switch.
Figure 3:
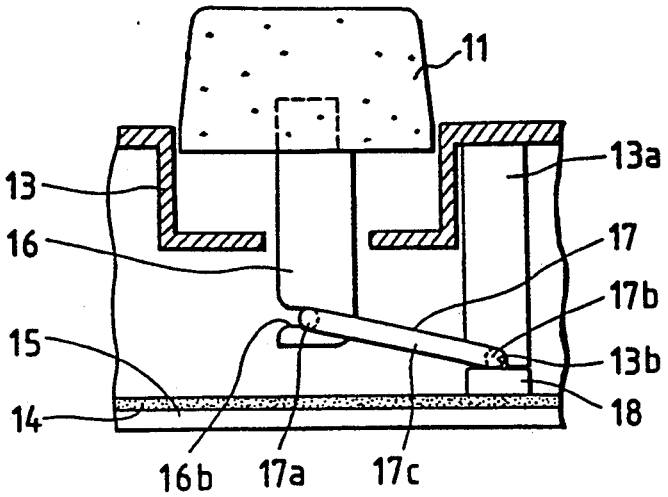
FIG. 3 PRIOR ART
FIG. 3 is a cross sectional view taken along line A—A in FIG. 2.
Figure 7:
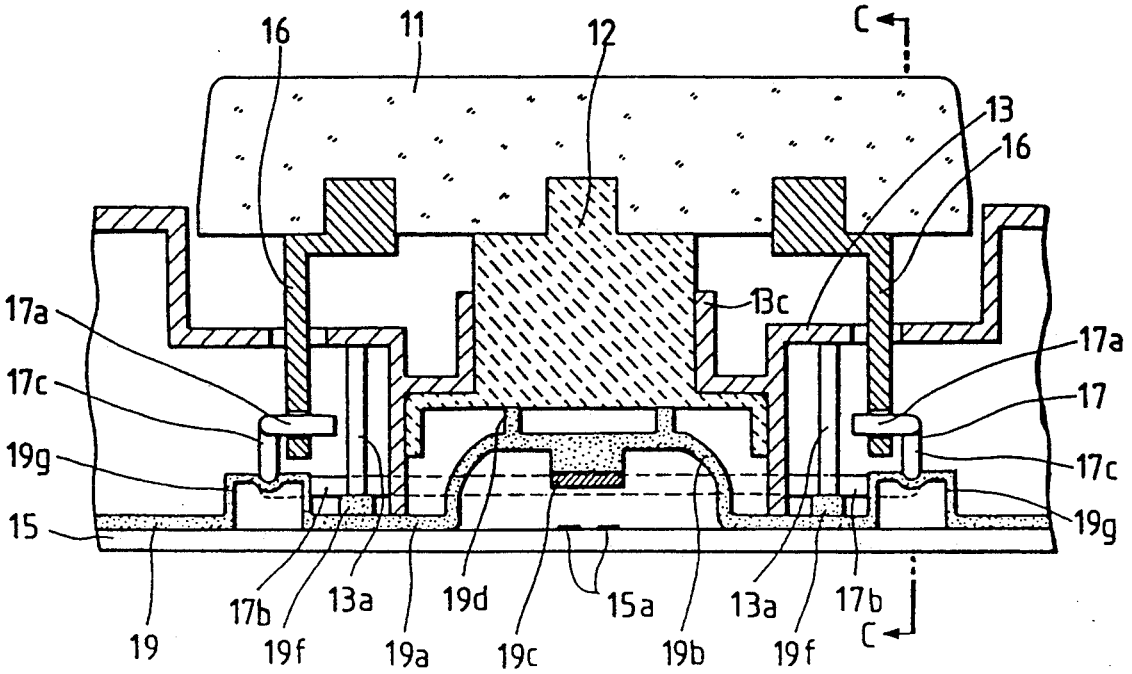
FIG. 7 is a vertical and front cross sectional view showing the structure of a key switch according to a third embodiment of this invention, which switch is of a second type of this invention and is an improved version of the second example of a conventional switch.
Figure 8:
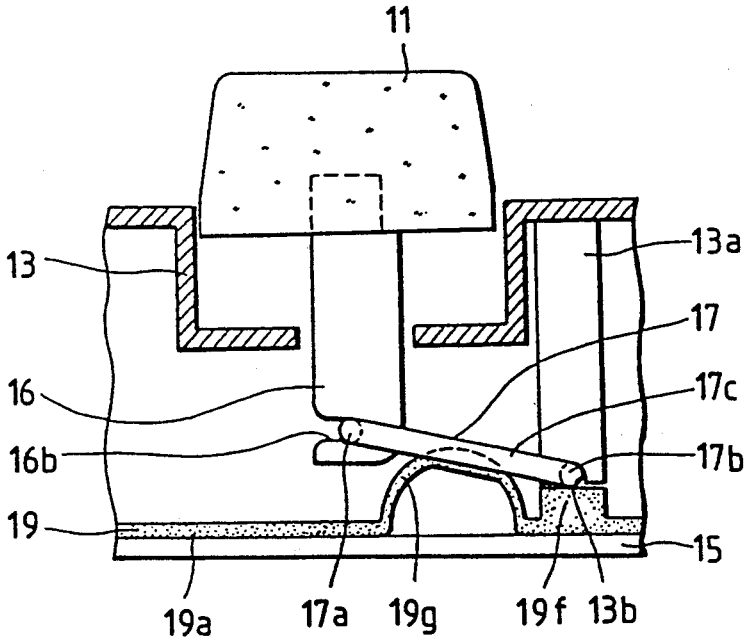
FIG. 8 is a cross sectional view taken along line C—C of FIG. 7.

FIGS. 7 and 8 show the structure of a key switch according to the third embodiment of this invention. In FIGS. 7 and 8, elements common and corresponding to those second example of a conventional switch shown in FIGS. 2 and 3 are represented by using identical reference numerals, and the description of the common elements is omitted.

The key switch of this embodiment shown in FIGS. 7 and 8 has a key sheet 19 made of an elastic material such as rubber, and is different from that of a conventional switch. The key sheet 19 is formed with projections 19*f* and expanded portions 19*g* both formed integrally with and extending upward from a base portion 19*a*.

Each projection 19*f* is a solid cube and is formed at the position facing each rib 13*a*. As shown in FIG. 8, the intermediate portion of a transmitting means in the form of a torsion bar 17 is entered into a groove 13*b* formed at the lower end of the rib 13*a*, and rotatably borne between the rib 13*a* and the projection 19*f*. The width of the groove 13*b* is smaller than the diameter of the torsion bar 17 so that a part of the intermediate portion 17*b* projects out of the groove 13*b* and is elastically pushed up by the projection 19*f*, thereby pressing the intermediate portion 17*b* of the torsion bar 17 against the inner surface of the groove 13*b*. In this manner, play is eliminated from the intermediate portion 17*b* when it is borne within the groove 13*b*. Since the projection 19*f* is elastically deformed, the play is eliminated by absorbing dispersions and work tolerances of the diameter of the torsion bar 17.

On the other hand, each expanded portion 19*b* is formed at the position facing each of the opposite end portions 17*c* of the torsion bar 17. The expanded portion 19*g* is formed hollow, contrary to the projection 19*f* which is formed solid. As shown in FIG. 8, the cross section of the expanded portion 19*g* taken along the plane parallel to an end portion 17*c* of the torsion bar 17 is a semicircle. The expanded portion 19*g* pressed by the end portion 17*c* of the torsion bar 17 and the semicircle is deformed. The repulsion force of this deformation causes the end portion 17*c* to be elastically pushed up. This pushing force by the expanded portion 19*g* acts against the end portion 17*c* even when the key top 11 is positioned at the top dead point. The pushing force from the expanded portion 19*g* causes the end portion 17*c* to be forcibly rotated in the clockwise direction as viewed in FIG. 8, so that an operation end 17*a* presses the upper surface of a groove 16*b* of a bar holder 16. Therefore, play in the operation end 17*a* relative to the bar holder 16 is eliminated.

The other structures and operations of this embodiment are the same as those of the above-described second example of a conventional switch.

According to this embodiment described above, an elastic pushing force exerted by the protrusion 19*f* and the expanded portion 19*g* eliminates the play of the torsion bar 17 at the bearing portion and the play of the torsion bar 17 at the coupling portion with the bar holder 16, i.e., at the coupling portion with the key top 11 integral with the bar holder 16. Therefore, the mechanism of the torsion bar 17 operating as described above smoothly follows the operation of the operation unit in the form of key top 11, thereby minimizing the inclination of the key top 11 while the end portion of the key top 11 is depressed. The key top 11 will not be trapped with another component as in the case where there is a large play in the torsion bar as in the above-described second example of a conventional switch, thereby allowing a reliable key input and an improved reliability of the key switch.

Furthermore, according to this embodiment, since there is in play in the torsion bar, discordant sounds during the operation of the key switch can be suppressed. Particularly, since the lower portion of the intermediate portion **17*b* of the torsion bar 17 is supported by the elastic projection 19*f*, even if an operator depresses the key top 11** abruptly, the impact can be cushioned and impact sounds can be absorbed.

Also in this embodiment, since the projection **19*f* and the expanded portion 19*g* are integrally formed with the key sheet 19, the number of components will not increase, but rather can be reduced because the holding member 18 (FIG. 3**) of the conventional switch is not used. It is therefore possible to reduce the number of assembly steps and the manufacturing cost.

In this embodiment structure, the pushing force of the expanded portion **19*g* to push up the end portion 17*c* of the torsion bar 17 is sufficient if it has a force required to make the operation end 17*a* of the torsion bar 17 contact the upper surface of the groove 16*b* when the key top 11 is at the top dead point. The expanded portion 19*g* is made hollow so as to have a small ratio of the repulsion force to the elastic deformation amount. This is because the switch operability is degraded if the repulsion force of the expanded portion 19*g* increases rapidly as the key top 11** is lowered.

It is obvious that the projection **19*f* and the expanded portion 19*g* are not limited to those described above. The key top 11 and the key stem 12 may be formed as a single component, and the bar holder 16 and the key top 11** may be formed as a single component.

As described above, the key switch of this invention is provided with a key top movable in the depression direction and the recovery direction opposite to the depression direction and an elastic sheet member, the elastic sheet member having a protrusion for elastically biasing the key top in the recovery direction, and a torsion bar generally of a U-character shape which is rotatably borne using as a fulcrum the intermediate portion thereof with its opposite end portions being movably coupled to the key top. A plurality of elastic pushing members are integrally formed with the elastic sheet member for elastically pushing the intermediate portion and the opposite end portions of the torsion bar and eliminating the play of the torsion bar at the bearing portion of the torsion bar and at the coupling portion of the torsion bar with the key top.

With the structure described above, therefore, the play of the torsion bar at the bearing portion and at the coupling portion with the key top can be eliminated to provide a torsion bar mechanism which easily follows the key top, without impeding the movement of the key top with another component and with improved reliability of the key switch. In addition, discordant noises during the operation can be made small, and the number of components and assembly steps can be reduced to reduce the cost of the device.

What is claimed is:

1. A key switch comprising:

key operating means having an operation unit, a key stem projecting from a lower and central position of the operation unit, and a pair of supporting units projecting from a lower surface of the operation unit;

a torsion bar, connected to said pair of supporting units, for transmitting a force exerted by a movement of one of the pair of supporting units of said key operating means to the other of the pair of supporting units;

circuit forming means having a fixed contact;

an elastic sheet member having a dome portion for pushing up the lower end of said key stem of said key operating means, and an expanded portion for biasing said torsion bar in such a manner that said torsion bar lifts up said pair of supporting units and said operation unit, wherein said elastic sheet member is connected to said key operating means; and a movable contact disposed on an inner surface of said dome portion of said elastic sheet member at a position facing said fixed contact of said circuit forming means.

2. A key switch according to claim 1, wherein said torsion bar has a rotary shaft at an intermediate portion thereof, and bent opposite end portions bent with respect to said intermediate portion, said opposite end portions being coupled to said pair of supporting units of said key operating means, whereby as one of the pair of supporting units is lowered upon depression of said key operating means, an angular moment is generated at one end of said torsion bar to rotate said rotary shaft at the intermediate portion and another end of said torsion bar is moved so that the other of the pair of supporting units is lowered to thereby prevent an inclination of said key operation means.

3. A key switch according to claim 1, wherein said elastic sheet member has a projection for elastically supporting an intermediate portion of said torsion bar.

4. A key switch according to claim 1, wherein an inside of the dome portion and an inside of the expanded portion respectively formed on said elastic sheet member are hollow.

5. A key switch comprising:

a key top movable between an upper and a lower position transmitting means, connected to said key top, for transmitting via a fulcrum a force exerted on said key top at one end of said key top to the other end of said key top;

an elastic sheet member, connected to said transmitting means, formed with a projection portion for supporting the fulcrum of said transmitting means, and an expanded portion for biasing a portion of said transmitting means other than the fulcrum of said transmitting means in order to prevent a play between a portion of said key top via which a force is transmitted from said key top to said transmitting means and said transmitting means and for causing said transmitting means to exert a force on said key top toward its upper position;

a first contact on said key top; and a second contact on an element on which said elastic sheet is supported, wherein said first contact engages said second contact when said key top is in its lower position.

* * * * *